US006647956B1

(12) United States Patent
Sharpton

(10) Patent No.: US 6,647,956 B1
(45) Date of Patent: Nov. 18, 2003

(54) SOUND ATTENUATING SYSTEM FOR A MARINE ENGINE

(75) Inventor: A. Dewayne Sharpton, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/119,564

(22) Filed: Apr. 10, 2002

(51) Int. Cl.[7] ..... F02M 3/12; F02M 35/12

(52) U.S. Cl. ..... 123/339.1; 123/184.53; 123/337; 123/339.26

(58) Field of Search ..... 123/337, 339.14, 123/339.13, 339.25, 339.26, 339.27, 339.28, 339.1, 184.53; 251/304, 305

(56) References Cited

U.S. PATENT DOCUMENTS 4,337,742 A 7/1982 Carlson et al. ..... 123/339
4,385,602 A * 5/1983 Itou et al. ..... 123/339.26
5,722,367 A 3/1998 Izydorek et al. ..... 123/339
6,360,708 B2 * 3/2002 Hwang et al. ..... 123/184.57

FOREIGN PATENT DOCUMENTS

DE 4323969 * 1/1994 ..... F02M/3/12
KR 2001061230 * 7/2001 ..... F02M/3/12

* cited by examiner

*Primary Examiner*—Tony M. Argenbright
*Assistant Examiner*—Hai H. Huynh
(74) *Attorney, Agent, or Firm*—William D. Lanyi

(57) ABSTRACT

A sound attenuator is provided for an idle air control valve system in order to reduce noise emanating from the idle air control valve. The sound attenuator comprises a fibrous pad that is inserted into an air conduit of the idle air control system. In a preferred embodiment, the fibrous pad is inserted into the air conduit near the air inlet where the conduit receives air from a region upstream, or above the throttle plate. A small hole can be provided through the air inlet. In certain embodiments, the air inlet of the air conduit is an opening formed in an inner cylindrical surface of the throttle body. In alternative embodiments, the air inlet can be remote from the internal surface of the throttle body.

8 Claims, 5 Drawing Sheets

SOUND ATTENUATING SYSTEM FOR A MARINE ENGINE

BACKGROUND OF THE INVENTION

1. Field of the Invention

The present invention is generally related to an air induction system of a marine engine and, more particularly, to a sound attenuating structural assembly for reducing the noise emanating from the region of an idle air control valve.

2. Description of the Prior Art

Many different types of internal combustion engines comprise an idle air control valve (IACV) for the purpose of regulating the flow of air into an intake manifold of an engine when the throttle plate within a throttle body is either closed or nearly closed.

U.S. Pat. No. 5,722,367, which issued to Izydorek et al on Mar. 3, 1998, describes an engine idle speed air control system. A control device for bypassing intake air around a closed throttle valve of an operating engine while it is idling is described. The device has a main flow control valve controlling bypass air flow and the bypass air passageway of the device which is moveable to closed and open positions by a diaphragm actuated by an engine intake vacuum controlled by a pilot valve actuated by a solenoid. The main valve, pilot valve and plunger of the solenoid are all movably received on and supported by a stationary slide rod which preferably extends into the coil of the solenoid and is supported adjacent only one end in a cantilever fashion. The main valve includes a main valve body with piston head movable with a flow clearance in and out of an air passage bore of the air outlet side of the bypass air passageway. An annular main valve seat is located at the open upstream of the bore through which the piston head moves in its axial travel between fully open and close positions of the main valve. The main valve also includes a flexible valve disc upstream of the valve body which is engageable with the main valve seat to fully close the same. The valve disc is controllably peeled off the main valve seat by a wedge shaped face of the piston head during initial opening travel of the main valve. The piston is also peripherally shaped to cooperate with the air passage bore and main valve seat to controllably vary the flow controlling cross sectional area of the bypass passageway and hence the bypass air flow rate as a function of incremental axial travel of the main valve along the slide rod.

U.S. Pat. No. 4,337,742, which issued to Carlson et al on Jul. 6, 1982, describes an idle air control apparatus for an internal combustion engine. The apparatus for a vehicle driving internal combustion engine has an air induction passage and includes a control valve in the air induction passage controlled by a stepper motor in response to the arithmetic count of applied electrical pulses. A register is used to store a valve control number representing the currently desired position of the control valve. Upon occurrence of a predetermined engine loading event, the system changes the valve control number in response thereto. An up-down counter is effective to arithmetically count the pulses applied to the stepper motor and thus indicate actual control valve position. A closed loop control is effective to compare the contents of the up-down counter and register and apply pulses to the stepper motor at the first predetermined rate to reduce any difference therebetween. A speed trim loop active only during occurrence of the predetermined steady state idle condition is used to compare actual engine speed with the desired engine idle speed and arithmetically change the valve control number in the register at a second predetermined rate substantially lower than the first predetermined rate to reduce any difference between the speeds. Therefore, idle air control responds to large, sudden engine load changes and environmental factors to prevent engine stall, but ignores small random speed fluctuations to maintain a stable engine idle.

The patents described above are hereby expressly incorporated by reference in the description of the present invention.

Various types of idle air control systems known to those skilled in the art will be described below in conjunction with FIGS. 1–4. Because of the sound that emanates from the region of an idle air control valve, it would be significantly beneficial if an inexpensive method could be provided for reducing the sound level caused both by the operation of the idle air control valve and the air flowing through the conduit associated with the idle air control system.

SUMMARY OF THE INVENTION

An idle air intake system for a marine engine, made in accordance with the preferred embodiment of the present invention, comprises a throttle body structure and a throttle plate rotatably supported within the throttle body structure. The throttle plate is rotatable in order to regulate a flow of air through the throttle body structure from a first region on a first side of the throttle plate to a second region on a second side of the throttle plate. An air conduit is provided with an inlet and an outlet, with the outlet being disposed in fluid communication with the second region, on the second side of the throttle plate, and the inlet being disposed in fluid communication with a location which is at a pressure generally equal to the pressure within the first region, on the first side of the throttle plate. The present invention further comprises a valve that is connected in fluid communication with the air conduit for controlling the rate of air flow from the inlet to the outlet. It also comprises a fibrous pad disposed within the air conduit proximate the inlet.

The fibrous pad can comprise a plurality of polyester fibers. The inlet of the air conduit can be disposed within a wall of the throttle body structure at a location above the throttle plate.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 2:
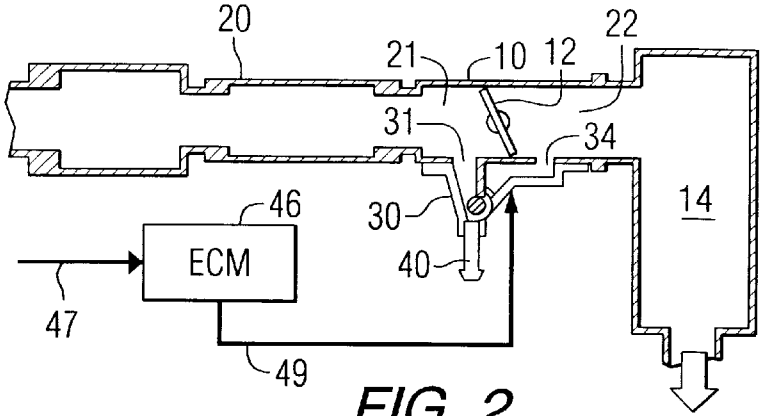
FIG. 2 PRIOR ART
FIGS. 1–4 show various types of prior art idle air control systems.

Throughout the description of the preferred embodiment of the present invention, like components will be identified by like reference numerals.

FIGS. 1–4 show various types of known idle air control systems. An idle air control (IAC) system is used to stabilize idle speed during cold engine operation and operation of the engine after warm-up operations. Idle speed stabilization is needed because of the effect that engine load changes have on emission output, idle quality, and vehicle drivability. A typical idle air control system uses an engine control module (ECM) that controls an idle air control valve (IACV) which regulates the volume of air bypassed around the closed throttle plate. The engine control module controls the valve by applying various input signals according to a program stored in the memory of the engine control module. The various types of idle air control valves used on automotive engines typically include stepper motor, duty control rotary solenoid, duty control air control valve, and on/off vacuum switching valve systems.

Figure 1:
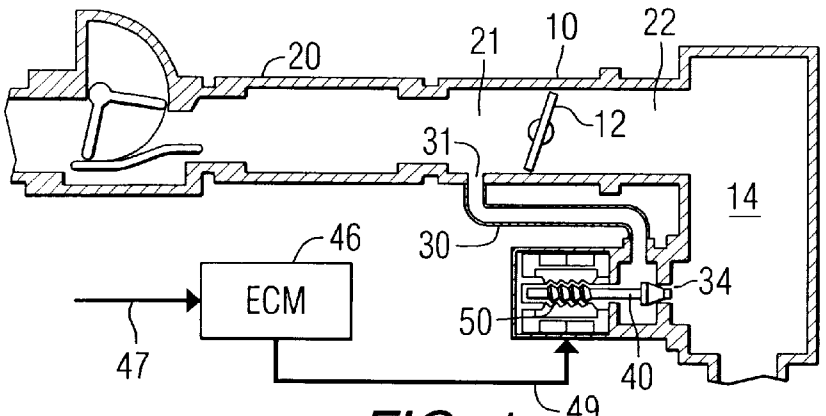
FIG. 1 PRIOR ART

FIG. 1 shows a stepper motor idle air control system. A throttle body 10 is provided with a throttle plate 12 for regulating the flow of air into an air intake chamber 14 and to the engine (not shown in FIG. 1). During normal operation of the engine, air flows through an air intake device 20 from a first region 21 on a first side of the throttle plate 12 to a second region 22 on a second side of the throttle plate 12. An air conduit 30 is provided with an inlet 31 and an outlet 34. The outlet 34 is disposed in fluid communication with the second region 22 and the inlet 31 is disposed in fluid communication with a location which is at a pressure generally equal to the pressure within the first region 21. Certain embodiments of idle air control systems connect the inlet 31 directly to the throttle body 10 at a location that provides direct flow of air from the first region 21 into the air conduit 30. Alternative embodiments, as will be described below, connect the inlet 31 of the conduit 30 to an alternative location which is at a pressure generally equal to the pressure within the first region 21 or at a pressure which is at least greater than the pressure in the second region 22 during operation of the engine. A valve 40 is connected in fluid communication with the air conduit 30 for controlling the rate of air flow from the inlet 31 to the outlet 34. In many systems of this type, an engine control module 46 is used to receive signals from various sensors associated with the internal combustion engine, as represented by arrow 47, and provide a control signal as represented by arrow 49, to the actuator 50 of the valve 40. The actuator 50 can be a solenoid or any other appropriate device that causes the valve 40 to selectively move into a blocking or unblocking relationship with the outlet 34.

With continued reference to FIG. 1, the idle air control valve 34 and its actuator 50 comprise a stepper motor, valve 40, and valve seat at the outlet 34 of conduit 30 for the purpose of bypassing air flow by positioning the valve 40 into one of numerous possible positions. The engine control module 46 controls the valve 40 by sequentially energizing its internal motor coils.

FIG. 2 shows a duty-control rotary solenoid idle air control system. Bypass air control is accomplished by means of a movable rotary valve which blocks or exposes a bypass port based on command signals from the engine control module 46. The valve consists of two electrical coils, a permanent magnet, a valve, a bypass port, and a bimetallic coil. The function of the system in FIG. 2 is similar to that of FIG. 1 in that operation of the valve 34 regulates the flow of air through the conduit 30 from the inlet 31 to the outlet 34. This bypasses air around the throttle plate 12 when the throttle plate is in its closed position.

Figure 3:
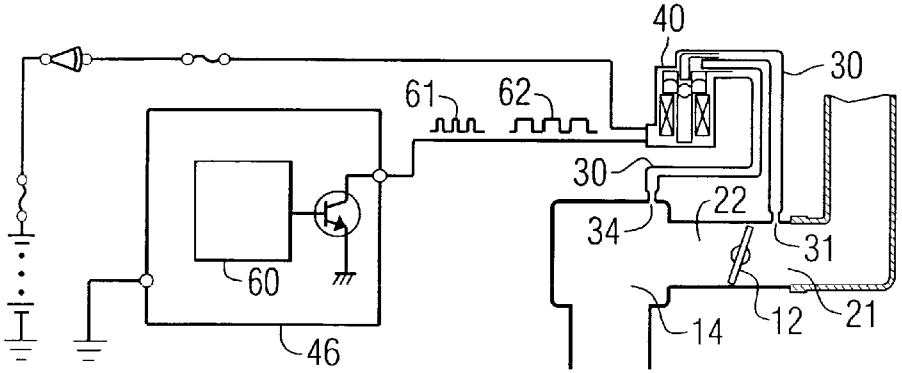
FIG. 3 PRIOR ART

FIG. 3 shows a duty-control air control valve system that bypasses a volume of air around a closed throttle plate 12 by using an engine control module 46 duty cycle which controls the valve system. A microprocessor 60 provides a series of sequential pulses which, by their duty cycle, causes the air control valve to either decrease the bypass air amount, as represented by pulses 61, or increase the bypass air amount, as represented by pulses 62.

Figure 4:
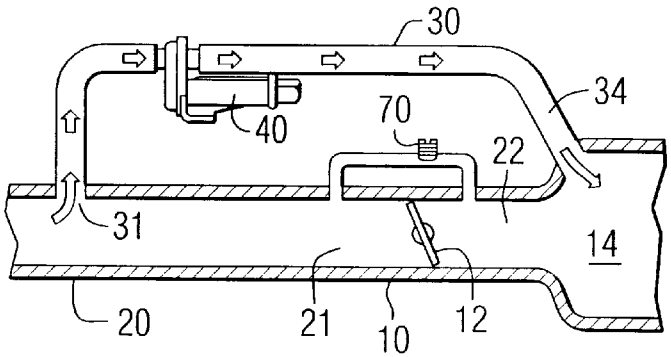
FIG. 4 PRIOR ART

FIG. 4 shows a type of idle air control valve that does not use an engine control module. One type uses a thermo-wax element to vary the amount of bypass air flowing through the air conduit 30 as a function of the coolant temperature of the engine. Once the engine reaches operating temperature, the valve 34 is generally closed. A second type of idle air control system that does not use an engine control module uses a spring loaded gate balanced against a bi-metal element. As engine temperature rises, the bi-metal element deflects to close the gate valve thereby reducing the amount of bypass air. In FIG. 4, an idle speed adjustment screw 70 is also illustrated.

With reference to FIGS. 1–4, all of the typical idle air control systems exhibit certain common characteristics. They allow air to flow around a closed throttle plate 12 from a first region 21 upstream from the throttle plate 12 to a second region 22 downstream from the throttle plate 12. This bypass function is performed through the use of an air conduit 30 that allows air to flow from an inlet 31 near the first region 21 to an outlet 34 near the second region 22. A valve is used to regulate the flow through the air conduit 30. Under certain conditions, such as during initial engine startup, air is allowed to flow through the air conduit 30 for the purpose of bypassing a closed throttle plate 12.

The operation of the idle air control valve 40 and the passage of air through the air conduit 30 can cause excessive noise. In certain applications, particularly in certain marine propulsion system applications, this noise can decrease the enjoyment of using a marine vessel. In order to address this issue of excessive noise emanating from the idle air control system, the present invention places a sound attenuating device in the air conduit 30.

Figure 5:
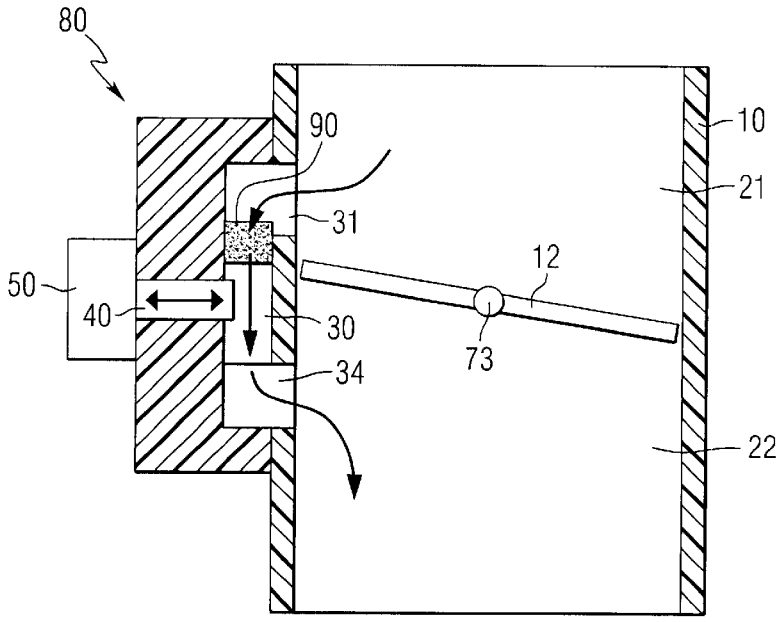
FIG. 5 is a schematic representation of an idle air control valve system incorporating the present invention.

FIG. 5 is a simplified schematic representation of an idle air control system comprising the present invention. A throttle body 10 has a throttle plate 12 rotatably supported, about a pivot 73, within the throttle body 10. An idle air control valve component, identified by reference numeral 80 in FIG. 5, is associated with the throttle body 10 to control the movement of the idle air control valve 40. The idle air control component 80 is functionally similar to those described above in conjunction with FIGS. 1–4. The particular operation and structure of the idle air control component 80 is not limiting to the present invention. Instead, the present invention can be used in conjunction with any of the known air control systems described above. The structure which is shown schematically in FIG. 5 operates in the manner described above in conjunction with FIGS. 1–4 in that an actuator 50 causes a valve member 40 to move into or out of blocking relation with an air conduit 30. When the air conduit 30 is open and the engine is operating with the throttle plate 12 closed as shown in FIG. 5, air can flow into the inlet 31, through the air conduit 30, and out of the outlet 34 to bypass the closed throttle plate 12. The inlet 31 is connected in fluid communication with the first region 21 on a first side, or upstream, of the throttle plate 12. The outlet 34 is connected in fluid communication with the second region 22, or downstream, of the throttle plate 12. A fibrous pad 90 is disposed within the air conduit 30 proximate the air inlet 31. Various types of fibrous pads 90 can be used in conjunction with the present invention, but it has been determined that a Scotch-Brite® pad, comprising polyester fibers, is particularly suitable in a preferred embodiment of the present invention. In certain embodiments of the present invention, the fibrous pad is formed from a section of a pad which is commercially available from the 3-M company and identified as a "Brand 4100 White Super Polished Pad". The pad is made of polyester fibers and synthetic adhesives and is not significantly affected by water, detergents, or cleaners. Its porosity is typically 95% and 98% resulting from its construction of approximately 2% to 5% solid material. The density of the pad is approximately 0.775 grams per cubic inch. The size of the ad will depend on the particular geometry of the air conduit 30 and its air inlet 31. In one embodiment of the present invention, the pad is approximately 18 millimeters in length and width and approximately 25 millimeters in thickness. However, it should be clearly understood that the size of the pad is dependent on the size of the air conduit 30 and the air inlet 31. The pad should be sized to fit within the air inlet 31 of the air conduit 30 with sufficient compression of the pad to hold the pad in place during operation of the associated internal combustion engine. In certain embodiments of the present invention, a small hole, approximately 3 millimeters in diameter, is formed through the thickness of the pad near a center of its top surface. This pad does not adversely affect the flow of air through the air conduit 30, but significantly decreases the noise emanating from the inlet. Although not shown in FIG. 5, it should be understood that a flame arrestor is commonly placed on the throttle body 10 above the first region 21. Noise which emanates from the idle air control valve can easily pass through the first region 21 and through the flame arrestor, if one is used, to be heard by the operator of a marine vessel. The fibrous pad 90 is relatively inexpensive, but effective for the purpose of attenuating sound which emanates from the idle air control system and, particularly, from the air conduit 30 and its inlet 31. The fibrous pad 90 is sized to fit into the air conduit 30 in such a way that its inherent shape holds the pad 90 in place within the air conduit 30. No additional fasteners or containments are required to maintain the pad 90 in its proper position.

Figure 6:
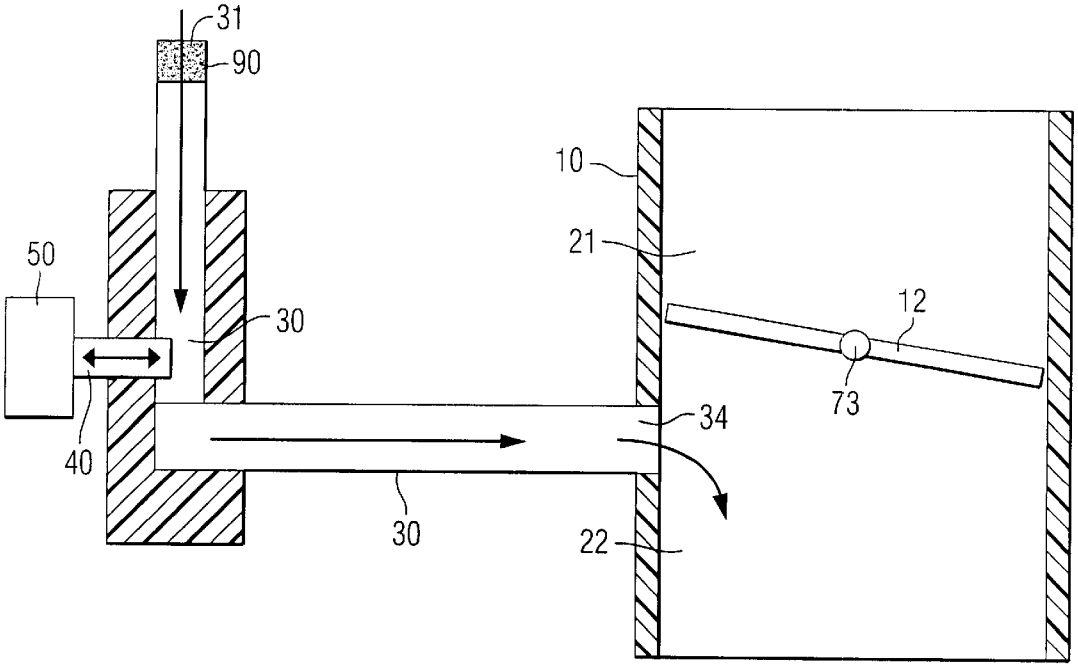
FIG. 6 is an alternative embodiment of an idle air control valve system incorporating the present invention.

FIG. 6 shows an alternative embodiment of an idle air control system which disposes the inlet 31 at a location other than within the first region 21. However, since the second region 22 downstream from the throttle plate 12 is at a pressure lower than atmospheric pressure during operation of the engine, the pressure at the inlet 31 of the air conduit 30 will be greater than the pressure within the second region 22. As a result, the pressure at the inlet 31 is generally similar, if not precisely equal, to the pressure in the first region 21. The fibrous pad 90 of the present invention is disposed in the air conduit 30 proximate the inlet 31, as illustrated schematically in FIG. 6. As a result, any noise emanating from the inlet 31 will be damped by the pad 90.

Figure 7A:
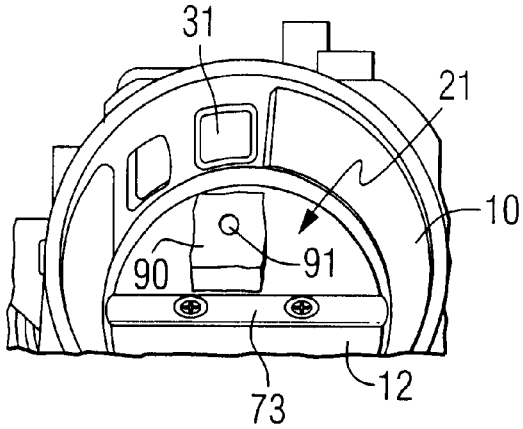
FIGS. 7A–7C show the method of installation of the present invention within an air conduit of a throttle body.
Figure 7B:
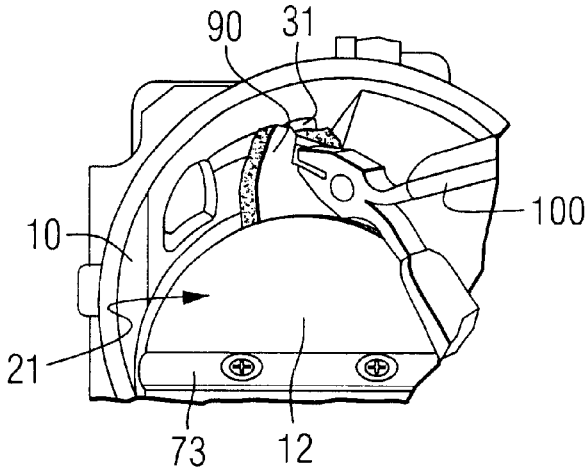
Figure 7C:
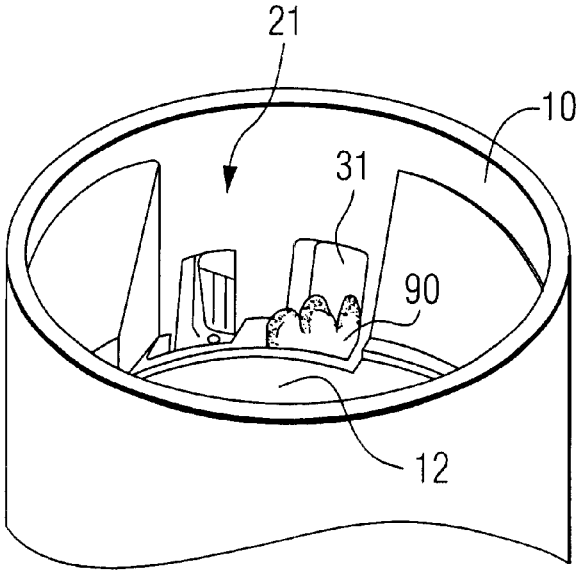

FIGS. 7A–7C show sequential steps for implementing the concepts of the resent invention. In FIG. 7A, the throttle body 10 is shown with the throttle plate 12 in a closed position. Above the throttle plate 12 and its pivot axis 73, the first region 21 is blocked from direct fluid communication with the second region 22 (not shown in FIG. 7A) which is downstream, or below, the throttle plate 12. The inlet 31 is located in an inner wall of the throttle body 10 in a manner generally similar to that illustrated in FIG. 5. The fibrous pad 90 is shown at a position resting on the top surface of the throttle plate 12 prior to installation into the air conduit which is connected in fluid communication with the inlet 31. FIG. 4 shows the relative sizes of the fibrous pad 90 and the inlet 31. The fibrous pad 90 is shaped to be slightly larger in its relative dimensions than the inlet 31 or the air conduit.

In FIG. 7B, needle-nosed pliers 100 are used to grip the fibrous pad 90 and insert it into the inlet 31. From the position shown in FIG. 7B, the fibrous pad 90 is then pushed downward in a preferred embodiment of the present invention to be located within the air conduit 30 (not shown in FIG. 7B) as illustrated in FIG. 5.

In FIG. 7C, the fibrous pad 90 is shown in its operational position within the air conduit 30. It is shown within the inlet 31, slightly above the bottom edge of the inlet. After this procedure, represented in FIGS. 7A–7C, is complete, the flame arrestor is replaced on top of the throttle body 10 if needed.

The purpose of the present invention is to reduce the noise emanating from an idle air control valve system by installing a fibrous pad into the air conduit 30 of the idle air control system. This reduces the air noise to an acceptable level in order to improve the enjoyment of operation of a marine vessel in which the idle air control valve system is used. However, it does not significantly reduce the amount of air needed by the engine when the throttle plate 12 is closed and the idle air control valve is operated. The shape of the fibrous pad 90 generally matches the shape of the inlet 31 and the air conduit 30. In a particularly preferred embodiment of the present invention, the small hole 91 of approximately 3 millimeters in diameter is provided through the thickness of the pad 90.

Figure 8:
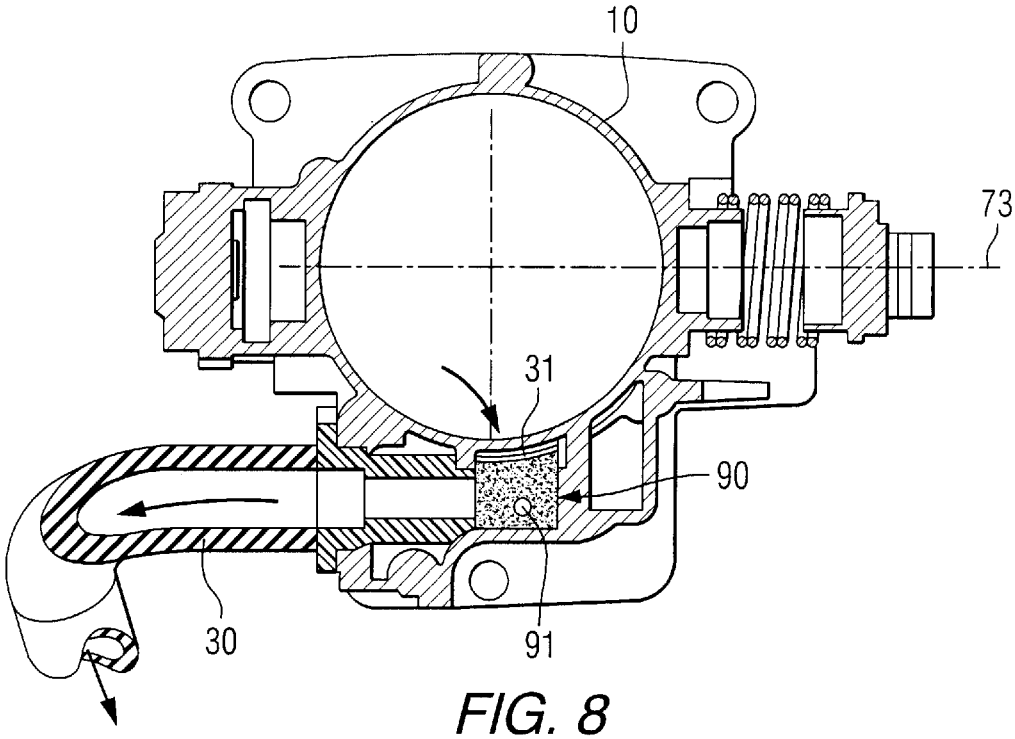
FIG. 8 is a section view taken through the throttle body, showing the location of the fibrous pad in the inlet of the air conduit.
Figure 10:
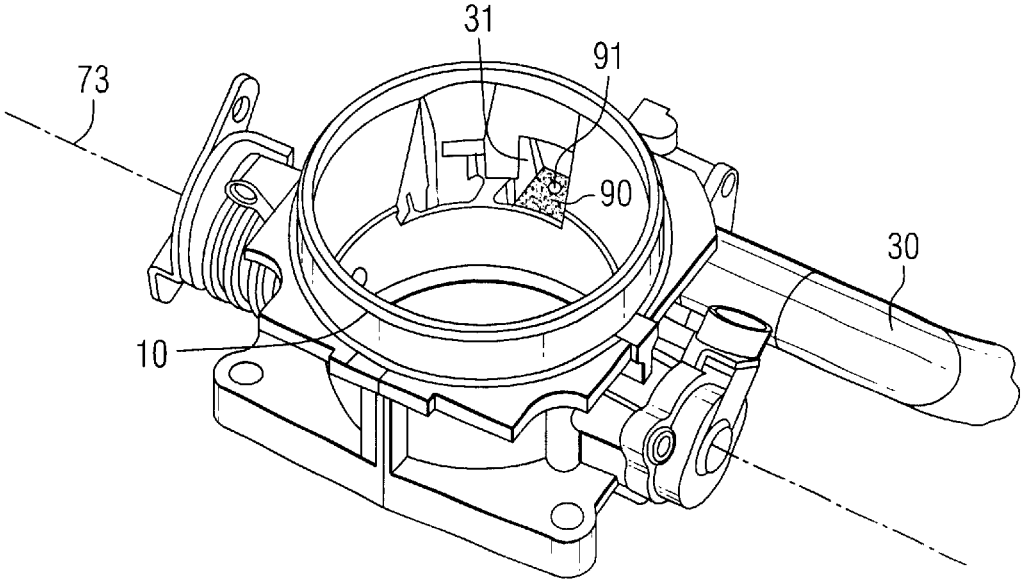
FIG. 10 is an isometric view of the throttle body showing the fibrous pad in the inlet and a portion of the air conduit extending from the throttle body.
Figure 9:
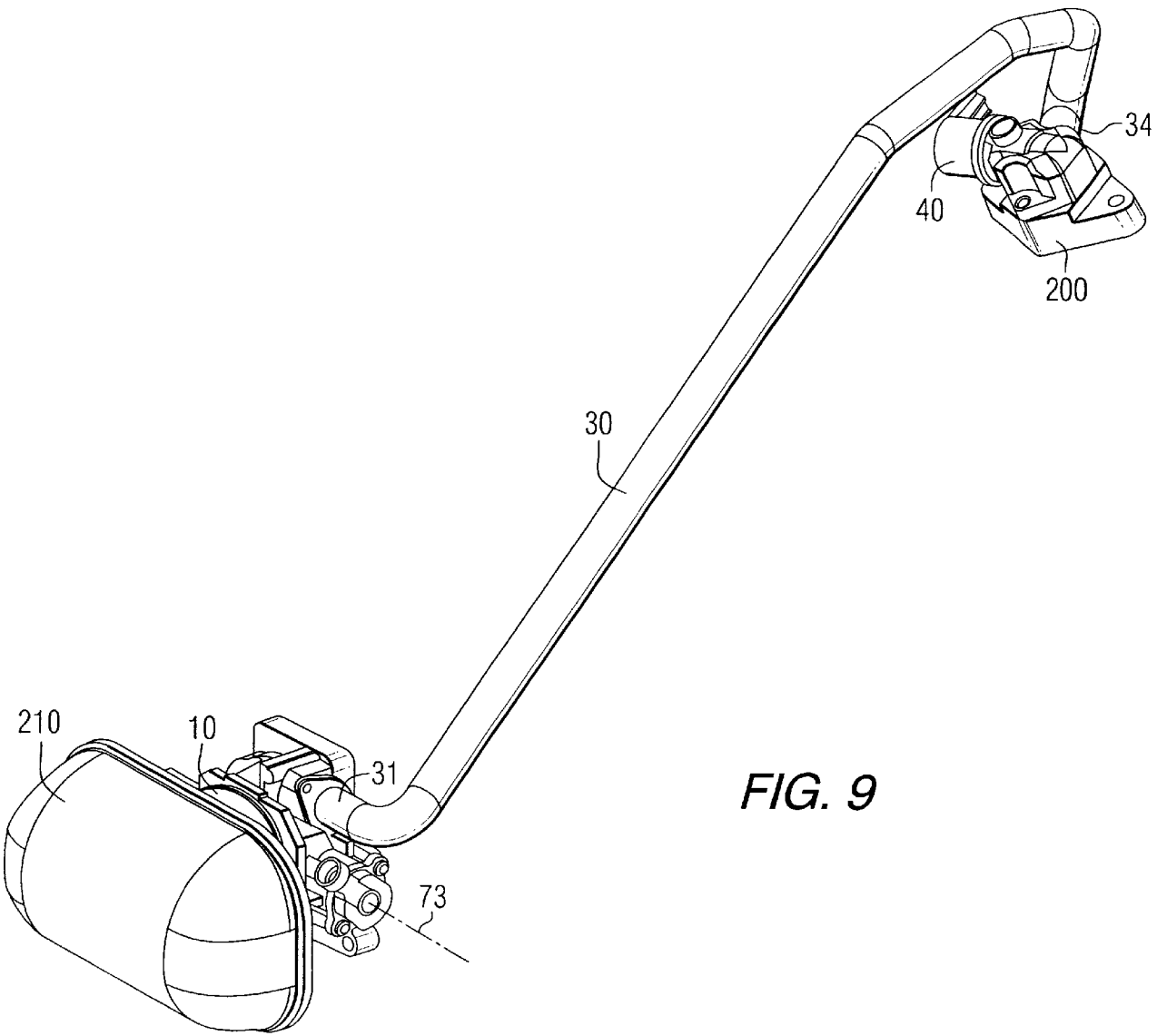
FIG. 9 is an assembled view of the throttle body, with its flame arrestor, a relatively long air conduit, and an idle air control valve located remotely from the throttle body.

FIGS. 8–10 show several views of an embodiment of the present invention in which the inlet 31 of the air conduit 30 is located within the inner cylindrical surface of the throttle body 10, but the outlet 34 is located remotely from the throttle body 10. The idle air control valve 40 is shown in FIG. 9 attached to a base portion 200 which is attachable to an air inlet plenum of the engine. During operation, air is drawn from the region at the upstream side of the throttle plate, through the inlet 31 and the through the fibrous pad 90 into the air conduit 30. Air travels through the air conduit 30, as illustrated in FIG. 9, toward its outlet 34 and when the idle air control valve 40 is opened. The air then flows through the base 200 and into the air inlet plenum of the engine.

In FIG. 8, the fibrous pad 90 is shown disposed within the structure of the inlet 31. The hole 91 formed in the fibrous pad can serve as a locator aid which assures that the fibrous pad 90 is in its proper configuration when the hole 91 is visible through inlet 31, as illustrated in FIG. 10. Air flows through the fibrous pad 90 and through the air conduit 30, as represented by the arrows in FIG. 8.

A flame arrestor 210 is shown attached to the intake end of the throttle body 10 in FIG. 9. Air flows from the throttle body, as described above, into the inlet 31, through the length of the air conduit 30, and out of the outlet 34 into the structure identified by reference numeral 200 in FIG. 9. FIG. 10 shows the fibrous pad 90 in place within the inlet 31.

Three embodiments of the present invention have been described above. One embodiment simply allows air to flow from the region above the throttle plate directly to a region below the throttle plate. Several of these embodiments, without the fibrous pad 90 illustrated, are described above in conjunction with FIGS. 1–4. An embodiment of the present invention is illustrated in FIG. 5, with the fibrous pad 90 disposed in the inlet 31 and the air conduit 30 directing air directly to a region below the throttle plate 12. An alternative to the embodiment of the present invention is shown in FIG. 6, where the inlet 31 is located at a remote location from the throttle body 10. In FIG. 9, the outlet 34 is located at a remote location from the throttle body 10.

Although the present invention has been described in particular detail and illustrated to show a preferred embodiment, it should be understood that alternative embodiments are also within its scope.

I claim:

1. An idle air intake system for a marine engine, comprising:

a throttle body structure;

a throttle plate rotatably supported within said throttle body structure, said throttle plate being rotatable to regulate a flow of air through said throttle body structure from a first region on a first side of said throttle plate to a second region on a second side of said throttle plate;

an air conduit having an inlet and an outlet, said outlet being disposed in fluid communication with said second region, said inlet being disposed in fluid communication with a location which is at a pressure generally equal to pressure within said first region;

a valve connected in fluid communication with said air conduit for controlling the rate of air flow from said inlet to said outlet; and a fibrous pad disposed within said air conduit.

2. The idle air intake system of claim 1, wherein:

said fibrous pad comprises a plurality of polyester fibers.

3. The idle air intake system of claim 1, wherein:

said inlet is disposed within a wall of said throttle body structure at a location above said throttle plate.

4. An idle air intake system for a marine engine, comprising:

a throttle body structure;

a throttle plate rotatably supported within said throttle body structure, said throttle plate being rotatable to regulate a flow of air through said throttle body structure from a first region on a first side of said throttle plate to a second region on a second side of said throttle plate;

an air conduit having an inlet and an outlet, said outlet being disposed in fluid communication with said second region, said inlet being disposed in fluid communication with a location which is at a pressure generally equal to pressure within said first region;

a fibrous polyester pad disposed within said air conduit proximate said inlet.

5. The idle air intake system of claim 4, wherein:

said inlet is disposed within a wall of said throttle body structure at a location above said throttle plate.

6. The idle air intake system of claim 4, further comprising:

a valve connected in fluid communication with said air conduit for controlling the rate of air flow from said inlet to said outlet.

7. An idle air intake system for a marine engine, comprising:

a throttle body structure;

a throttle plate rotatably supported within said throttle body structure, said throttle plate being rotatable to regulate a flow of air through said throttle body structure from a first region on a first side of said throttle plate to a second region on a second side of said throttle plate;

an air conduit having an inlet and an outlet, said outlet being disposed in fluid communication with said second region, said inlet being disposed in fluid communication with a location which is at a pressure generally equal to pressure within said first region;

a fibrous polyester pad disposed within said air conduit proximate said inlet; and an idle air control valve connected in fluid communication with said air conduit for controlling the rate of air flow from said inlet to said outlet.

8. The idle air intake system of claim 7, wherein:

said inlet is disposed within a wall of said throttle body structure at a location above said throttle plate.

* * * * *